US005263264A

United States Patent [19]

Usui et al.

[11] Patent Number: 5,263,264

[45] Date of Patent: Nov. 23, 1993

[54] METHOD AND APPARATUS FOR DRYING WET WORK

[75] Inventors: Eiji Usui; Junichi Sugai, both of Kanagawa, Japan

[73] Assignee: Speedfam Clean System Company Limited, Ayase, Japan

[21] Appl. No.: 761,883

[22] PCT Filed: Jan. 24, 1991

[86] PCT No.: PCT/JP91/00077

§ 371 Date: Sep. 17, 1991

§ 102(e) Date: Sep. 17, 1991

[30] Foreign Application Priority Data

Jan. 25, 1990 [JP] Japan ..... 2-15915
Jan. 8, 1991 [JP] Japan ..... 3-18212

[51] Int. Cl.[5] ..... F26B 7/00

[52] U.S. Cl. ..... 34/12; 34/15; 34/92; 134/21

[58] Field of Search ..... 34/5, 15, 92, 17, 39, 34/40, 11, 12; 134/11, 21

[56] References Cited

FOREIGN PATENT DOCUMENTS

| | | | |
|---|---|---|---|
| 54924 | 4/1984 | Japan | 34/92 |
| 103832 | 7/1985 | Japan | 34/92 |
| 1533340 | 9/1986 | Japan | 34/92 |
| 102234 | 10/1986 | Japan | 34/92 |
| 196529 | 12/1986 | Japan | 34/92 |
| 54443 | 3/1987 | Japan | 34/92 |
| 53549 | 8/1987 | Japan | 34/92 |

*Primary Examiner*—Henry A. Bennet
*Attorney, Agent, or Firm*—Fitch, Even, Tabin & Flannery

[57] ABSTRACT

A method and an apparatus for drying a wet work, for example, subsequent to a washing operation, in which a work is dried in an accelerated and precise manner free of stains or spots by means of: a hot D.I. water drying section 1 adapted to heat a work by immersion in hot D.I. water 11 and then to pull out the work for drying same; a vacuum drying section 2 adapted to dry off residual moisture on the work in a vacuum vessel under reduced pressure; and a work transfer means arranged to transfer the work from the hot D.I. water drying section 1 to the vacuum drying section 2.

17 Claims, 3 Drawing Sheets

METHOD AND APPARATUS FOR DRYING WET WORK

BACKGROUND OF THE INVENTION

1. Field of the Invention

This invention relates to a method and an apparatus for drying a work of glass, metal or other materials, and more particularly to a method and an apparatus for drying a wet work, for example, subsequent to a washing operation, by a high precision operation keeping work surfaces free of stains or spots.

2. Description of the Prior Art

There has thus far been known in the art the so-called hot D.I. (deionized) water bath drying as described, for example, in Japanese Laid-Open Patent Application 64-53549, in which a wet work which has undergone a washing treatment is immersed in a hot D.I. water bath of a predetermined temperature and then pulled out of the bath to let the work dry by its own heat. This hot D.I. water bath drying which does not resort to any organic solvent has been drawing much attention as an optimum technology for drying various articles since it is free of the problem of environmental contamination and simple in terms of operational facilities and maintenance.

In the hot D.I. water bath drying, however, one sometimes meet a problem that water remains on a particular part of a work which has been lifted out of a hot D.I. water bath, taking a longer drying time than other parts of the work and leaving a spot or stain on that part due to delayed drying. This problem is likely to occur particularly when drying a work of a shape which easily picks up water thereon, for example, a work with a broad upturned surface, a blind hole, a recess and so forth. A work which has been lifted out of the hot D.I. water bath gradually cools off as it is deprived of evaporation heat in the course of drying, making it difficult to dry off promptly the water droplets which remain on particular regions of the cooled work. These droplets tend to result in spots or stains unless they are evaporated promptly.

In this regard, it is known to blast hot air against a wet work to accelerate its drying. However, this method has a number of problems which bar precise drying operations, for example, irregularities in the degree of drying depending upon the direction of hot blasts and spots or stains of water droplets which are blown by hot blasts and relocated on or along dried surface of the work in the evaporating and drying phases of the operation. Besides, depending upon the shape of the work, a work surface which bears water droplets may become a dead zone relative to the hot blasts, necessitating an objectionably long drying time. There arises another problem that the work is susceptible to contamination with dust since dust in a drying chamber or from a hot air source is also blasted against the work.

Further, in the so-called vacuum drying method which is also known in the art, water pools or droplets on a work surface need to be evaporated by thermal energy of the work itself. Therefore, in a case where a work is subjected to vacuum drying in a cooled state after a washing operation, the work might be freezed by a further temperature drop or might take a considerably long time for drying. In this connection, it is conceivable to provide a heater on the vacuum drying machine as an auxiliary heating means for the work. However, there has to be provided a heating device of large scale to serve for this purpose, in addition to the difficulty of transferring heat efficiently and uniformly from the heating device to the work within a reasonably short period of time. For example, in a process where a work is successively subjected to washing and drying operations, it is almost impossible to complete the drying operation in a short time period, namely, to impart necessary thermal energy to the work to a sufficient degree within a limited time (e.g., about 5 minutes) which is allotted to the drying operation. Besides, there is another problem that the work is likely to be contaminated during the vacuum drying operation with dust coming from the heater for the work and the gaskets which are used for sealing the vacuum vessel.

SUMMARY OF THE INVENTION

It is an object of the present invention to provide a method and an apparatus which are capable of drying a wet work promptly in a reliable manner irrespective of the shape of the work.

It is another object of the invention to provide a method and an apparatus which are capable of drying a wet work precisely, free of contamination with dust during drying operation.

In accordance with the present invention, the above-stated objectives are achieved by the combination of a first drying section for drying a wet work with a hot D.I. water bath, a second drying section for vacuum-drying the work, and a work transfer means for transferring the work between the first and second drying sections, the wet work being preliminarily heated and dried by immersion in hot D.I. water in the first drying section, then transferred from the first to second drying section by the work transfer means while the work retains heat, and placed in a vacuum vessel in the second drying section to undergo vacuum drying under reduced pressure.

According to the invention, after the hot D.I. water drying, a work which still retains sufficient heat energy is treated with vacuum drying, so that there is no need for preheating the work prior to the vacuum drying. Namely, it becomes possible to omit or minimize the preheating equipments or time as would be required when a work is directly subjected to vacuum drying without preliminary drying with hot D.I. water. In addition, the combination of hot D.I. water drying and vacuum drying permits to evaporate water droplets promptly in a reliable manner even in case of a work of a special shape which would readily pick up water droplets thereon, thus precluding irregularities in the degree of drying as well as spots or stains due to delayed drying of water droplets.

The above-mentioned vacuum vessel may be of either single-wall structure or double-wall structure.

In case of double wall structure, the vacuum vessel is constituted by a double-wall casing including an outer vessel serving as a pressure container, an inner vessel serving as a container for accommodating a work, and a pressure-resistant lid for opening and closing the outer vessel. The inner vessel is provided with vent holes in its bottom wall to communicate the interiors of the outer and inner vessels with each other. The outer vessel is connected to a vacuum pump, and the lid is provided with a leak hole which is opened into the inner vessel and arranged to be opened and closed by a valve. After placing a work in the inner vessel, the outer vessel is evacuated by the vacuum pump to hold same under reduced pressure.

With the above-described vacuum vessel of double wall structure having its outer and inner vessels communicated with each other through the vent holes in the bottom wall of the inner vessel, the air streams from the inner to the outer vessel are choked at the vent holes when evacuating the vacuum vessel by the use of the vacuum pump and when returning the vacuum vessel to the atmospheric pressure upon completion of a drying operation, constantly maintaining the inner vessel at a higher pressure level than the outer vessel. This pressure differential contributes not only to prevent migration of dust from the outer to inner vessel but also to discharge dust in the inner vessel promptly to the outside.

The vacuum vessel may be interiorly provided with an infrared heater to irradiate a work with infrared ray during the vacuum drying operation. In case of a vacuum vessel of double wall structure, it is preferable to provide an infrared ray transmissive portion in part of side walls of the inner vessel, and to locate the infrared heater between the inner and outer vessels in such a manner as to irradiate a work in the inner vessel through the infrared ray transmissive portion. This arrangement facilitates the irradiation by infrared ray because the work in the inner vessel can be protected against the influence of dust which might come from the infrared heater.

The afore-mentioned lid is preferred to have an absolute filter for filtration of leak air which flows into the inner vessel through the leak hole.

The lid is provided with inner and outer seal portions which hermetically engage the inner and outer vessels, respectively. Preferably, these seal portions are arranged to seal firstly the inner vessel and then the outer vessel with a certain time delay at the time of closing the vacuum vessel.

Further, the inner vessel is preferred to be supported in the outer vessel resiliently through suitable resilient support means.

The above and other objects, features and advantages of the invention will become apparent from the following description and the appended claims, taken in conjunction with the accompanying drawings which show by way of example preferred embodiments of the invention.

DESCRIPTION OF PREFERRED EMBODIMENTS

Figure 1:
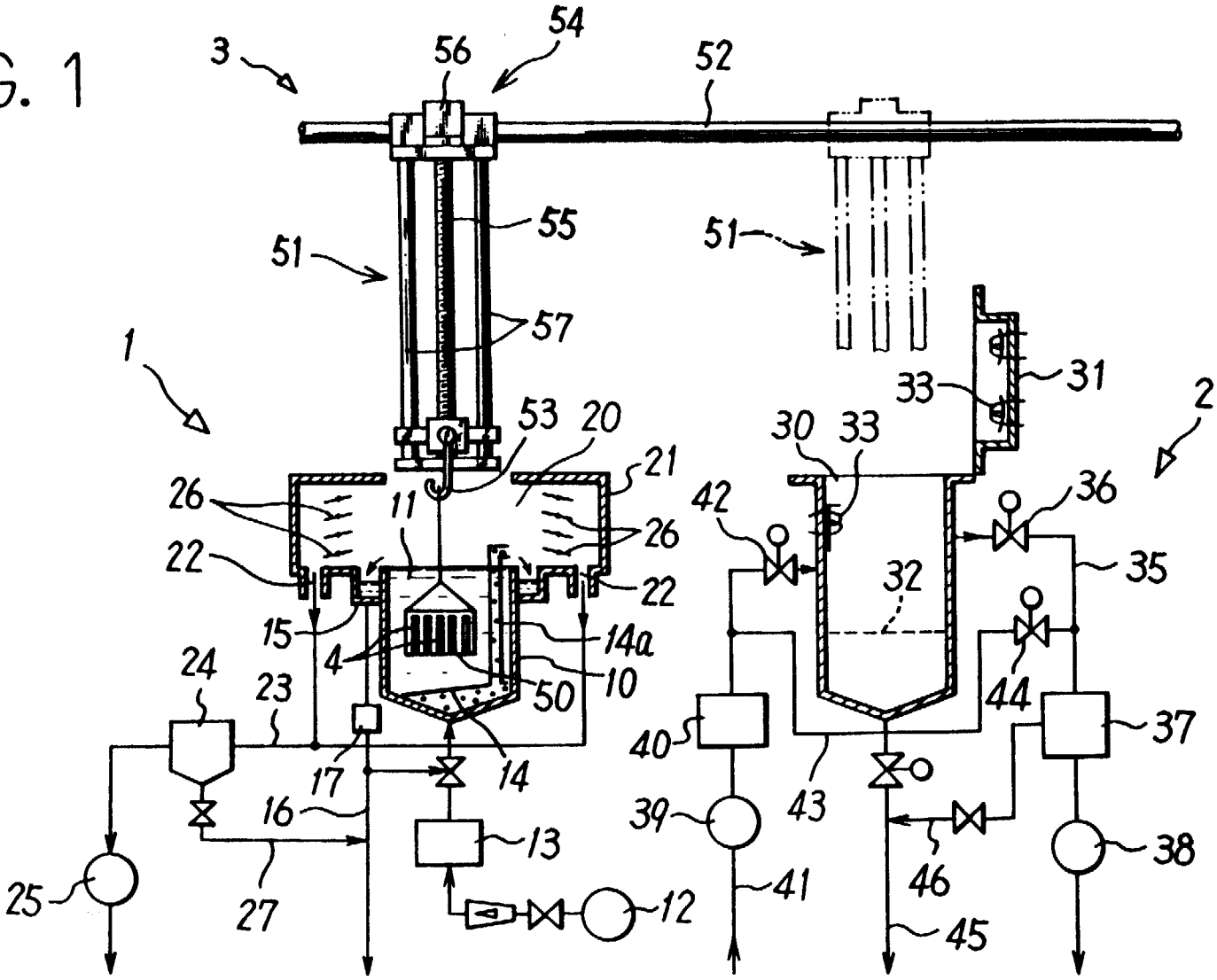
FIG. 1 is a schematic sectional view of a first preferred embodiment of the invention.

Referring to the first embodiment FIG. 1, the drying apparatus of the invention is largely constituted by: a first drying section or hot D.I. water drying section 1 where a wet work 4 from a washing machine or the like is heated by immersion in a hot D.I. water bath and then lifted out of the bath for drying; a second drying section or vacuum drying section 2 where the heated and dried work 4 from the hot D.I. water drying section is put in a vacuum vessel 30 under reduced pressure to dry off residual moisture on the work; and a work transfer means 3 for transferring the work 4 from the hot D.I. water drying section 1 to the vacuum drying section 2.

The hot D.I. water drying section 1 includes a hot D.I. water bath 10 which holds hot D.I. water 11 which has been heated to a predetermined temperature after removal of impurities. The hot D.I. water bath 10 is connected at its bottom portion to a D.I. water source 12 through a heater 13. D.I. water from the water source 12 is heated to a predetermined temperature at the heater 13 and continuously supplied to the hot D.I. water bath 10 at a constant rate. The heater 13 may be provided in a bottom portion of the bath 10 to heat up D.I. water within the bath 10, if desired.

It is preferable to provide, in the hot D.I. water bath 10, a bubble trap 14 for collecting air bubbles which are generated in D.I. water while being supplied or while being heated by the heater 13 provided in the bath, discharging the collected bubbles to the outside through a discharge pipe 14*a*. By so doing, it becomes possible to prevent the adverse effects of air bubbles which would cause rippling to the surface of hot D.I. water 11.

Hot D.I. water which overflows from the bath 10 is collected in a water collecting groove 15 which is formed around the upper end of the bath 10, and discharged to the outside through a water collecting pipe 16. In this instance, a heat-resistant filter 17 may be provided in the water collecting pipe 16 to remove impurities from hot D.I. water to be returned to the heater 13 or D.I. water source 12 for recirculation.

Provided overhead the hot D.I. water bath 10 is a drying chamber 20 which is enclosed by partition walls 21 to accelerate the drying speed and which has its exhaust port 22 connected to a fan 25 through an exhaust pipe 23 and a mist catch 24. Steam rising from the water surface and the surface of the work 4 is sucked and discharged by the fan 25 to prevent the work 4 from being wetted by contact with steam. In this instance, for the purpose of sucking steam in a horizontal direction which is effective for preventing the undesired contact with the work, the drying chamber 20 is interiorly provided with a plural number of flaps 26 the angle of which is adjustable to create horizontal air streams. Water which has been collected by the mist catch 24 is discharged to the aforementioned water collecting pipe 16 through a water discharge pipe 27.

On the other hand, installed at the vacuum drying section 2 is a vacuum vessel 30 which can be opened and closed by a lid 31 and interiorly provided with a work table 32 for holding a work 4 thereon and a heater 33 serving as an auxiliary drying means for the work 4. The vacuum vessel 30 is connected to a vacuum pump 38 by an evacuation pipe 35 through a valve 36 and a cold trap 37, and at the same time connected through a valve 42 to an atmospheric air induction pipe 41 with a heater 39 and an air filter 40. These evacuation pipe 35 and air induction pipe 41 are communicated with each other through a connector pipe 43 and a valve 44. Further, connected to the bottom of the vacuum vessel 30 is a water discharge pipe 45 for discharging water which has dropped from the work 4. The water discharge pipe 45 and cold trap 37 are connected with each other through a connector pipe 46. The cold trap 37 is provided arbitrarily whenever necessary, for the purpose of separating steam which would otherwise be sucked into the vacuum pump 38 together with air, and for the purpose of preventing mist of lubricant oil of the vacuum pump 38 from inversely flowing into the vacuum vessel through the evacuation pipe 35 to contaminate the work 4.

The heater 33 in the vacuum vessel can be constituted by a suitable heat source such as an infrared lamp, panel heater or the like.

Further, the work transfer mechanism 3 is provided with a transfer arm 51 for suspending a work holder 50, for example, a basket or cassette of a shape suitable for holding a work 4. The transfer arm 51 is moved along a guide 52 by a suitable drive means such as ball screw, timing belt, piston-cylinder or the like. The transfer arm 51 is constituted by a hook 53 for suspending the work holder 50, a drive means including a ball screw 55 and a motor 56 for lifting the hook 53 up and down, and a pair of guides 57 for guiding upward and downward movements of the hook 53. The above-mentioned drive means 54 of the hook 53 may be constituted by a timing belt or piston-cylinder if desired.

The drying apparatus of the above-described arrangement is installed, for example, in a position posterior to a washing machine to dry articles which are received from the latter in a wet state.

Namely, as soon as a work 4 in the suspended work holder 50 is delivered to a position above the hot D.I. water bath 10 of the first drying section 1 by the work transfer arm 51, the hook 53 is lowered to immerse the work 4 in hot D.I. water 11 together with the work holder 50. At this time, hot D.I. water of a predetermined temperature is supplied to the hot D.I. water bath 10 of the first drying section 1 continuously at a constant rate. Overflowing hot D.I. water is received in the water collecting groove 15 and discharged through the water collecting pipe 16. In the meantime, air in the drying chamber 20 is sucked by the air exhaust fan 25, and steam from the water surface is discharged together with the sucked air streams.

After heating the work 4 by immersion in hot D.I. water 11 for a predetermined time period, the hook 53 is lifted up slowly to pull out the work 4 gently at a low speed which would not cause rippling to the water surface. As a result, pulled-out portions of the work 4 get dried sequentially by the heat of the work 4 itself. In the drying chamber 20, steam rising from the water surface is discharged substantially in horizontal directions by the exhaust fan 25 to preclude its contact with the work 4. Therefore, the dried surface of the work 4 has no possibility of being re-wetted with steam or of re-moistening which would result in irregularities in the degree of drying or stains.

The temperature of hot D.I. water 11 is suitably determined in consideration of the nature of the work 4 and the heat resistance of the filter 17 or other associated equipments, but is desirable to be as high as possible within a range which would not cause thermal degeneration. For example, in case the work 4 is of glass, aluminum or other metal, a suitable bath temperature is about 80° C. Of course, a lower bath temperature may be employed if desired. The time of immersion of the work 4 in hot D.I. water 11 and its pull-out speed vary depending upon the temperature of hot D.I. water 11 and the nature of the work 4. For example, in a case where the temperature of hot D.I. 11 is 80° C. and the work 4 is a flat glass sheet to be used as a metering instrument cover, it is suitable to employ an immersion time of about 30–60 seconds and a pull-out speed of 8–12 mm/sec. In case the work 4 is a die cast product of aluminum, it is advisable to use an immersion time of about 30–60 seconds and a pull-out speed of 5–8 mm/sec. After the work 4 has been completely pulled out of hot D.I. water 11, it may be lifted at a higher speed than the above-mentioned pull-out speed to perform the succeeding operations in an accelerated manner.

Upon completion of the hot D.I. water drying, the work 4 is immediately transferred to the vacuum drying section 2 by the work transfer arm 51 while the work 4 is in heated state. As the work transfer arm 51 comes to a position above the vacuum vessel 30 with the lid 31 in opened position, the hook 53 is lowered to place the work 4 in the work holder 50 on the table 32, and then the hook 53 is disengaged from the work holder 50. The disengaged hook 53 is lifted up, while the lid 31 is closed. At this time, the water droplets, which would form a pool at the bottom of the vacuum vessel 30 by flowing down from a broad upturned surface, blind hole or recess on the work 4, are discharged through the water discharge pipe 45.

Nextly, simultaneously with closing of the valve 42 of the air induction pipe 41, the valve 36 of the suction pipe 35 is opened to evacuate air in the vacuum vessel 30 by the vacuum pump 38. As soon as the vacuum vessel 30 reaches a predetermined vacuum level, the valve 42 is opened to a suitable degree to let heated air from the heater 39 flow in at a suitable rate through the air induction pipe 41 while maintaining the vacuum vessel at a predetermined vacuum level (e.g., approximately 4.5 torr) to effect the vacuum drying of the work 4 in that state. In this instance, the work 4 is supplementarily heated by the internal heater 33 if necessary.

In this vacuum drying, the moisture which had not been completely removed from an upturned surface or a blind hole or recess of the work 4 in the preceding hot D.I. water drying operation is immediately removed by evaporation. Accordingly, there is no possibility of development of spots or stains which would be made by water droplets when left on the work 4 over a long time period after the hot D.I. water drying. Besides, the work 4 is free of stains which would be made in hot air drying in which water droplets are blown and moved along the work surface by hot blasts. The supply of hot air and the heating by the internal heater 33 prevent temperature drops of the work 4 during the vacuum drying operation, preventing the work 4 from freezing and thus improving the drying efficiency. However, in a case where arrangements are made to effect the vacuum drying on the work 4 which still retains sufficient thermal energy after the hot D.I. water drying, the supply of hot air and the heating by the internal heater 33 are not necessarily required and may be omitted.

The time for the vacuum drying varies depending upon the nature of the work 4 but normally it suffices to be in the range of about 30–300 seconds.

After finishing the vacuum drying in this manner, the internal pressure of the vacuum vessel 30 is returned to the atmospheric pressure, and the lid 31 is opened to lift up the work 4 by the transfer arm 51 along with the work holder 50 for transfer to a next stage.

A deaerator may be provided between the heater 13 and the D.I. water source 12 of the hot D.I. water drying section 2 thereby to reduce the dissolved gas content in D.I. water to a level below the saturated gas solubility at the heated temperature, prior to heating D.I. water at the heater 13. The prior reduction of the dissolved gas content prevents generation of air bubbles in D.I. water in a reliable manner when the feed of D.I. water is heated by the heater 13.

Figure 2:
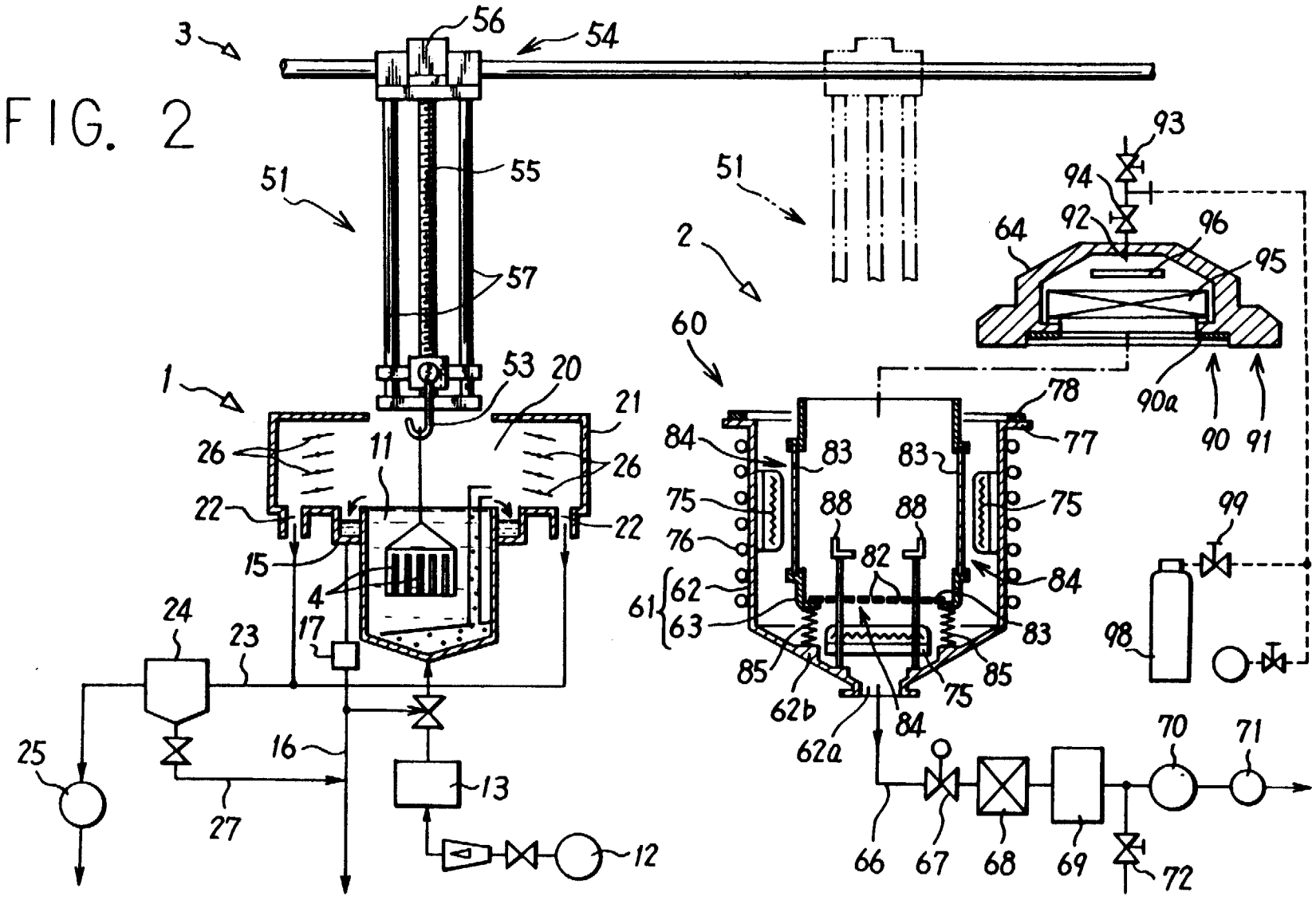
FIG. 2 is a view similar to FIG. 1 but showing a second preferred embodiment of the invention.
Figure 3:
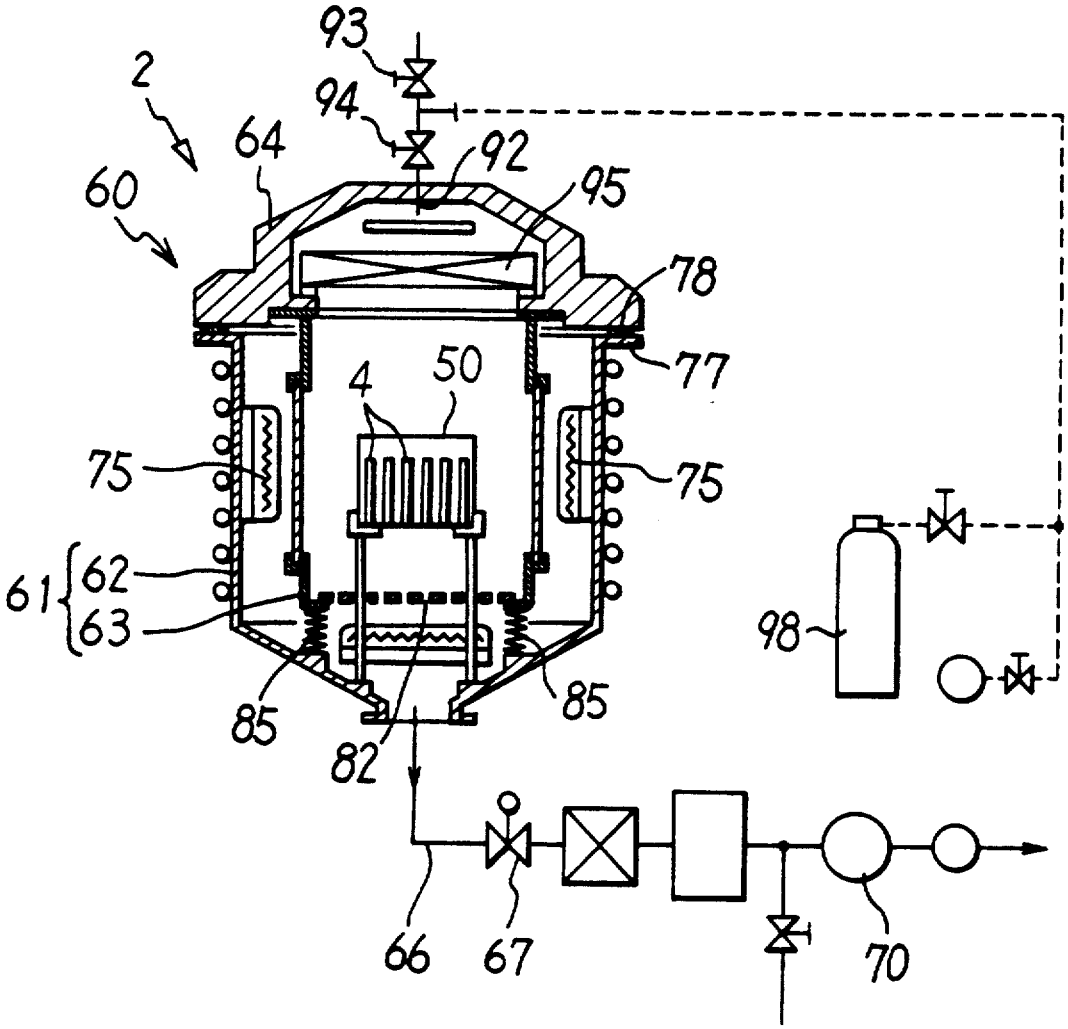
FIG. 3 is a schematic sectional view of a vacuum drying section in drying operation.

Shown in FIGS. 2 and 3 is a second embodiment of the invention, which is same as the above-described first embodiment except the arrangement of the vacuum drying section 2. Therefore, the hot D.I. water bath drying section 1 is designated by the same reference numerals as in the first embodiment and its description is omitted to avoid repetitions.

The vacuum drying section 2 has a vacuum vessel 60 which is constituted by a square double-wall vessel 61 and a lid 64 for opening and closing the vessel 61. The vessel 61 is composed of an outer vessel 62 serving as a pressure container, and an inner vessel 63 provided within the outer vessel 62 to accommodate a work 4. Formed at the lower end of the outer vessel 62 is a suction port **62*a* which is connected to a vacuum pump 70 by a suction pipe 66 through electromagnetic exhaust valve 67, filter 68 and sorption trap 69 to evacuate the interior of the vacuum vessel 60** to a predetermined vacuum level.

In these figures, the reference 71 denotes an exhaust fan, and 72 denotes an electromagnetic check valve which is connected to the suction pipe 66 between the vacuum pump 70 and sorption trap 69. This electromagnetic check valve 72 serves to open the suction pipe 66 when the vacuum pump 70 is at rest, thereby preventing reverse flow of the atmosphere of the vacuum pump 70 toward the vacuum vessel 60.

The vacuum vessel 60 is internally provided with an infrared heaters 75 in a space between the inner and outer vessels 63 and 62. Wrapped around the circumference of the outer vessel 62 is a cooling pipe 76 through which a cooling medium such as water is circulated for cooling the vacuum vessel 60 which is heated by the heater 75. For hermetically sealing the lid 64 in closed state, a gasket 78 is provided on a flange portions 77 which is formed at and around the upper end of the outer vessel 62.

On the other hand, the inner vessel 62 is formed of a material with suitable resistance to heat and corrosion like stainless steel, aluminum alloy or glass, and has a large number of vent holes 82 in its bottom wall to intercommunicate the inner and outer vessels 63 and 62 in a somewhat throttled fashion. The four side walls and bottom wall of the inner vessel form an infrared transmissive portion 84, constituted by panels 83 of quartz glass or similar heat-resistant material which can transmit infrared rays from the infrared heaters 75. In the particular embodiment shown, a similar panel 83 is also provided at the bottom of the inner vessel 63 to form an infrared transmissive portion 84 with the aforementioned vent holes 82. However, the bottom wall of the inner vessel is not necessarily required to have the infrared transmissive portion 84, and the vent holes 82 may be formed directly through the bottom wall of the inner vessel 63. In the latter case, the infrared heater 75 at the bottom is omitted.

The inner vessel 63 is resiliently supported on the bottom wall **62*b* of the outer vessel 62 through a resilient means 85 such as springs or the like, so that, when the lid 64 is opened, the upper end of the inner vessel 63 is protruded above the upper end of the outer vessel 62 by the biasing action of the resilient means 85. Further, the surfaces of the inner vessel 63** are mirror-finished to preclude deposition of dust.

Provided within the inner vessel 63 are four stands 88 as means for supporting the work holder 50 which holds the work 4. These stands 88 are each fixed on the bottom wall **62*b* of the outer vessel 62 and projected into the inner vessel 63** through the bottom wall thereof.

The lid 64 is liftable and transversely movable into an open position by a drive means such as a fluid cylinder or the like not to obstacle the work loading and unloading operations by the work transfer arm 51. For hermetically closing the inner and outer vessels 63 and 62, the lid 64 is provided with, along the outer periphery thereof, an inner vessel seal portion 90 to be engaged with the upper end of the inner vessel 63 and an outer vessel seal portion 91 to be engaged with the gasket 78 at the upper end of the outer vessel 62. When the lid 64 is lowered from the upper open position to close the vacuum vessel 61, the inner vessel seal portion 90 is firstly abutted against the upper end of the inner vessel 63 which is protruded above the outer vessel 62, and, after sealing the inner vessel 63 resiliently through the intervention of the resilient means 85, the outer vessel seal portion 91 is closed on the upper end of the outer vessel 62 in a slightly delayed manner.

The above-mentioned inner vessel seal portion 90 has a seal member **90*a* such as a gasket or the like attached thereto in the embodiment shown. However, the seal member 90*a* may be attached to the upper end of the inner vessel 63 instead of the seal portion 90, or may be completely omitted provided that the upper end of the inner vessel 62 and the lid 64 are engaged with each other intimately through mirror-finished surfaces of high precision flatness. Alternatively, the gasket 78 at the upper end of the outer vessel 62 may be provided on the outer vessel seal portion 91 or may be completely omitted in case the upper end of the outer vessel 62 and the seal portion 60 on the lid 64** are likewise engaged with each other through mirror-finished surfaces of high precision flatness.

Formed at the top of the lid 64 is a leak hole 92 which opens into the inner vessel 63 when the lid 64 is closed, for supplying leak air into the vacuum vessel 60. The leak hole 92 is communicated with the atmosphere through a leak valve 93 and an automatic flow regulator valve 94 which can adjust the air flow rate. The lid 64 is interiorly provided with a filter 95 to remove dust and other foreign matter from leak air to be supplied. This filter 95 is an absolute filter like a HEPA filter which covers the top side of the inner vessel 63 to supply leak air from the leak valve 93 to the inner vessel 63 in the form of a vertical laminar flow. Accordingly, the atmosphere in the inner vessel 63 is improved by leak air without forming turbulent flows therein. In the drawing, the reference 96 denotes a baffle plate which is provided opposingly beneath the leak hole 92.

An inert gas source 98 is connected between the leak valve 93 and automatic regulator valve 94 through an on-off valve 99 to supply an inert gas such as nitrogen gas or the like. The inert gas is supplied continuously during the vacuum drying operation.

In the drying apparatus of the above-described second embodiment, as soon as the work 4, which has undergone the hot D.I. water drying, is transferred by the work transfer arm 51 to a position above the vacuum vessel 60 with the lid 64 in open position (FIG. 2), the hook 53 is lowered to place the work 4 in the work holder 50 on the stands 88 in the inner vessel 63. After releasing the work holder 50, the hook 53 is lifted, and in turn the lid 64 is lowered to close the vacuum vessel 61 (FIG. 3). At this time, the inner vessel seal portion 90 on the lid 64 is firstly abutted against the upper end of the inner vessel 63 which is protruded above the outer vessel 62, hermetically sealing the inner vessel 63. Then, the lid 64 is further lowered together with the inner vessel 63 by compressing the resilient means 85 until the outer vessel seal portion 91 is hermetically closed on the upper end of the outer vessel 62. By hermetically closing the inner and outer vessels 63 and 62 sequentially in this manner, it becomes possible to prevent intrusion of dust into the inner vessel 63, which might occur when the lid 64 is pressed against the gasket 78 at the upper end of the outer vessel 62.

Upon completion of the closure of the lid 64, the infrared heaters 75 are turned on and the electromagnetic exhaust valve 67 is opened, starting evacuation of the vacuum vessel 60 by the vacuum pump 70. At this time, the interior of the outer vessel 62 is evacuated by the vacuum pump 70, which sucks air in the outer vessel 62 directly but sucks air in the inner vessel 63 indirectly through the vent holes 82. Since the vent holes 82 has a throttling effect as mentioned hereinbefore, the pressure in the inner vessel 63 is constantly maintained at a slightly higher level than the pressure in the outer vessel 62. Therefore, even if dust is blown up within the outer vessel 62 by turbulent air streams resulting from the evacuation, it has no possibility of entering the inner vessel 63. On the other hand, dust in the inner vessel 63 is sucked out and discharged promptly through the vent holes 82.

In this manner, the vacuum vessel is evacuated to a predetermined vacuum level to carry out the vacuum drying of the work.

The vacuity of the vacuum vessel 60 can be increased moderately by opening the leak valve 93 while gradually closing the automatic flow regulator valve 94. In order to effect the vacuum drying in inert gas flows, the leak valve 93 is closed and the automatic flow regulator valve 94 is opened to a necessary degree to supply a suitable amount of inert gas from the inert gas source 98.

Instead of turning on simultaneously with the closure of the lid 64, the infrared heaters 75 may be controlled to be set at a predetermined temperature from the start.

Further, in evacuating the vacuum vessel 60, leak air may be supplied to the vessel through the leak valve 93 in an initial stage of evacuation. In such a case, the automatic flow regulator valve 94 is opened in a throttled state, so that leak air is sucked into the inner vessel 63 from the leak valve 93 in a cleaned state through the filter 95 to flow out through the vent holes 82. Therefore, dust which may exist in the inner vessel 63 is carried away with leak air to keep the inner vessel 63 in clean state. On the other hand, the dust which has occurred between the inner and outer vessels 63 and 62 is kept from entering the inner vessel 63, which is maintained at a slightly higher pressure level than the outer vessel 62 as mentioned hereinbefore.

After effecting the leak for a preset time period, the automatic flow regulator valve 94 and leak valve 93 are closed to evacuate the vacuum vessel 60 to a predetermined vacuum level.

At this time, the vacuity of the inner vessel is lowered to a certain degree due to evaporation of moisture, so that the pressure in the inner vessel 63 is maintained at a slightly higher level than the pressure between the inner and outer vessels 63 and 62, precluding the possibilities of dust from the infrared heaters 75 or other components entering the inner vessel 63 to deposit on the work 4.

Upon finishing the vacuum drying, the leak valve 93 and automatic flow regulator valve 94 are opened in a predetermined timed relation with closure of the electromagnetic exhaust valve 67 to bring the internal pressure of the vacuum vessel 60 to the atmospheric level, and then the lid 64 is opened to eject the work 4 and the work holder 50 for transfer to a next stage of operation.

In a case where an inert gas is used for the drying operation, the inert gas is supplied to the automatic flow regulator valve 94 while holding the leak valve 93 in closed state, and the electromagnetic exhaust valve 67 and automatic flow regulator valve 94 are closed in a predetermined timing to restore the atmospheric pressure in the vacuum vessel 60. Namely, if the electromagnetic exhaust valve 67 is closed while the inert gas is still being supplied, the internal pressure of the vacuum vessel 60 is elevated continuedly until the closure of the automatic flow regulator valve 94 which is timed with restoration of the atmospheric pressure in the vacuum vessel 60.

When the leak valve 93 is opened to restore the atmospheric pressure in the vacuum vessel 60, leak air flows into the inner vessel 63 to elevate the pressure of the inner vessel 63 prior to the outer vessel 62, thus constantly maintaining the inner vessel 63 at a higher pressure level than the outer vessel 62. It follows that dust particles which might be whirled up in the outer vessel 62 by leak air has no possiblity of entering the inner vessel 63. On the other hand, should dust occur in the inner vessel 63, it is promptly discharged into the outer vessel 62 through the vent holes 82.

In place of the stands 88, the work support means in the inner vessel 63 of the vacuum vessel 60 may employ hooks which are suspended from the lower surface of the lid 64 and which are arranged to lift up and down the work and work holder together with the lid 64.

Needless to say, the work may be directly transferred without using a work holder as described hereinbefore.

What is claimed is:

1. A method for drying a wet work, comprising:
   heating a wet work by immersion in hot deionized water and lifting up said work to undergo hot deionized water drying;
   transporting said work from said hot deionized water drying operation to a separate vacuum vessel; and
   placing said word in said vacuum vessel under reduced pressure while said work retains imparted heat energy to undergo vacuum drying.

2. A method for drying a wet work as defined in claim 1, wherein said vacuum vessel is of single-wall structure.

3. A method for drying a wet work as defined in claim 2, wherein said vacuum vessel is internally provided with a heater for heating said work during said vacuum drying.

4. A method for drying a wet work by heating said work in hot deionized water and lifting up said work to undergo hot deionized water drying, and placing said work in a vacuum vessel under reduced pressure while said work retains imparted heated energy to undergo vacuum drying, characterized in that said method comprises: employing a vacuum vessel of double wall structure having an inner vessel for receiving said work and an outer vessel serving as a pressure container, said inner and outer vessels being communicated with each other through vent holes formed in a bottom wall of said inner vessel, and said outer vessel being connected to a vacuum pump for evacuation thereof.

5. A method for drying a wet work as defined in claim 4, wherein said vacuum vessel is provided with an infrared heater between said inner and outer vessels to irradiate said work through infrared transmissive portions provided in walls of said inner vessel.

6. An apparatus for drying a wet work, comprising:

a hot deionized water drying section arranged to heat a wet work by immersion in hot deionized water and to lift up said work to effect hot deionized water drying;

a vacuum drying section arranged to dry off residual moisture on said work in a vacuum vessel under reduced pressure, subsequent to said hot deionized water drying; and a work transfer means adapted to transfer said work from said hot deionized water drying section to said vacuum drying section.

7. An apparatus for drying a wet work as defined in claim 6, wherein said vacuum vessel is of single-wall structure.

8. An apparatus for drying a wet work as defined in claim 6, wherein said vacuum vessel is internally provided with a heater for heating said work.

9. An apparatus for drying a wet work, comprising:

a hot deionized water drying section arranged to heat a wet work by immersion in hot deionized water and to lift up said work to effect hot deionized water drying;

a vacuum drying section arranged to dry off residual moisture on said work in a vacuum vessel under reduced pressure, subsequent to said hot deionized water drying; and a work transfer means adapted to transfer said work from said hot deionized water drying section to said vacuum drying section;

said vacuum vessel being of double-wall structure having an inner vessel for receiving said work therein, an outer vessel serving as a pressure container, and a lid for opening and closing said vacuum vessel, said inner vessel being provided with vent holes in a bottom wall thereof to intercommunicate said inner and outer vessels, said outer vessel being connected to a vacuum pump, and said lid being provided with a valved leak hole opening into said inner vessel.

10. A method for drying a wet work in accordance with claim 1 wherein said vacuum vessel is of double-wall structure.

11. An apparatus for drying wet work as defined in claim 6, wherein said vacuum vessel is of double-wall structure.

12. An apparatus for drying a wet work, comprising:

a hot deionized water drying section arranged to heat a wet work by immersion in hot deionized water and to lift up said work to effect hot deionized water drying; and a vacuum drying section arranged to dry off residual moisture on said work in a vacuum vessel of double wall structure under reduced pressure, subsequent to said hot deionized water drying.

13. An apparatus for drying a wet work, comprising:

a hot deionized water drying section arranged to heat a wet work by immersion in hot deionized water and to lift up said work to effect hot deionized water drying;

a vacuum drying section arranged to dry off residual moisture on said work in a vacuum vessel under reduced pressure, subsequent to said hot deionized water drying; and a work transfer means adapted to transfer said work from said hot deionized water drying section to said vacuum drying section;

said vacuum vessel being of double-wall structure having an inner vessel for receiving sid work therein, an outer vessel serving as a pressure container, and a lid for opening and closing said vacuum vessel, said inner vessel being provided with vent holes in a bottom wall thereof to intercommunicate said inner and outer vessels, said outer vessel being connected to a vacuum pump, and said lid being provided with a valved leak hole opening into said inner vessel wherein said inner vessel is provided with an infrared transmissive portion at least in part of side walls thereof, and an infrared heater is provided between said inner and outer vessels to irradiate said work through said infrared transmissive portion.

14. An apparatus for drying a wet work, comprising:

a hot deionized water drying section arranged to heat a wet work by immersion in hot deionized water and to lift up said work to effect hot deionized water drying;

a vacuum drying section arranged to dry off residual moisture on said work in a vacuum vessel under reduced pressure, subsequent to said hot deionized water drying; and a work transfer means adapted to transfer said work from said hot deionized water drying section to said vacuum drying section;

said vacuum vessel being of double-wall structure having an inner vessel for receiving sid work therein, an outer vessel serving as a pressure container, and a lid for opening and closing said vacuum vessel, said inner vessel being provided with vent holes in a bottom wall thereof to intercommunicate said inner and outer vessels, said outer vessel being connected to a vacuum pump, and said lid being provided with a valved leak hole opening into said inner vessel wherein said lid is provided with an absolute filter for filtering leak air flowing into said inner vessel through said leak hole.

15. An apparatus for drying a wet work, comprising:

a hot deionized water drying section arranged to heat a wet work by immersion in hot deionized water and to lift up said work to effect hot deionized water drying;

a vacuum drying section arranged to dry off residual moisture on said work in a vacuum vessel under reduced pressure, subsequent to said hot deionized water drying; and a work transfer means adapted to transfer said work from said hot deionized water drying section to said vacuum drying section;

said vacuum vessel being of double-wall structure having an inner vessel for receiving sid work therein, an outer vessel serving as a pressure container, and a lid for opening and closing said vacuum vessel, said inner vessel being provided with vent holes in a bottom wall thereof to intercommunicate said inner and outer vessels, said outer vessel being connected to a vacuum pump, and said lid being provided with a valved leak hole opening into said inner vessel wherein said lid is provided with inner and outer vessel seal portions arranged in hermetically close upper ends of said inner and outer vessels sequentially, firstly closing said inner vessel and then said outer vessel with a certain delay.

16. An apparatus for drying a wet work, comprising:

a hot deionized water drying section arranged to heat a wet work by immersion in hot deionized water and to lift up said work to effect hot deionized water drying;

a vacuum drying section arranged to dry off residual moisture on said work in a vacuum vessel under reduced pressure, subsequent to said hot deionized water drying; and a work transfer means adapted to transfer said work from said hot deionized water drying section to said vacuum drying section;

said vacuum vessel being of double-wall structure having an inner vessel for receiving sid work therein, an outer vessel serving as a pressure container, and a lid for opening and closing said vacuum vessel, said inner vessel being provided with vent holes in a bottom wall thereof to intercommunicate said inner and outer vessels, said outer vessel being connected to a vacuum pump, and said lid being provided with a valved leak hole opening into said inner vessel wherein said inner vessel is resiliently supported within said outer vessel.

17. An apparatus for drying a wet work comprising:

a hot deionized water drying section arranged to heat a wet work by immersion in hot deionized water and to lift up said work to effect hot deionized water drying;

a vacuum drying section arranged to dry off residual moisture on said work in a vacuum vessel;

a work transfer means adapted to transfer said work from said hot deionized water drying section to said vacuum drying section;

a lid for opening and closing said vacuum vessel;

a valved leak hole within said lid adapted to be opened and closed and opening into said vacuum vessel; and a filter provided inside said lid for removing dust and other foreign matter from leak air supplied to sid vacuum vessel.

* * * * *